US006048280A

United States Patent [19]

Palmer et al.

[11] Patent Number: 6,048,280

[45] Date of Patent: Apr. 11, 2000

[54] SYSTEM FOR LUMINESCING AND PROPELLING A PROJECTILE

[75] Inventors: Stephen L. Palmer; William R. Palmer, both of Cameron Park, Calif.

[73] Assignee: Sierra Innotek, Inc., Cameron Park, Calif.

[21] Appl. No.: 08/891,185

[22] Filed: Jul. 10, 1997

Related U.S. Application Data

[63] Continuation-in-part of application No. 08/644,959, May 13, 1996, abandoned, which is a continuation of application No. 08/218,075, Mar. 25, 1994, abandoned.

[51] Int. Cl.[7] ..... A63B 61/00

[52] U.S. Cl. ..... 473/416; 473/570; 273/DIG. 24; 124/1; 124/16

[58] Field of Search ..... 473/416, 578, 473/570; 362/84, 112, 113; 273/DIG. 24; 124/16, 20.1, 20.2, 20.3, 21, 22, 26, 27

[56] References Cited

U.S. PATENT DOCUMENTS

| | | | |
|---|---|---|---|
| 689,547 | 12/1901 | James | 362/113 |
| 2,321,077 | 6/1943 | Gora et al. | 124/16 |
| 2,568,279 | 9/1951 | Franz et al. | 273/DIG. 24 |
| 2,905,863 | 9/1959 | Martin et al. | 315/183 |
| 2,977,580 | 3/1961 | Sprecher | 362/113 |
| 3,114,362 | 12/1963 | Hellman | 124/27 |
| 3,582,623 | 6/1971 | Rothery | 235/61.11 E |
| 3,859,977 | 1/1975 | Lange | 273/344 |
| 3,902,722 | 9/1975 | Skillern | 273/DIG. 24 |
| 3,968,784 | 7/1976 | Miller | 124/27 |
| 5,028,047 | 7/1991 | Lee et al. | 273/DIG. 24 |
| 5,311,413 | 5/1994 | Framer et al. | 362/84 |
| 5,415,151 | 5/1995 | Fusi et al. | 124/56 |
| 5,762,058 | 6/1998 | Cheng et al. | 124/56 |

*Primary Examiner*—Jessica J. Harrison
*Assistant Examiner*—Sheila D. Clayton
*Attorney, Agent, or Firm*—Thomas R. Lampe

[57] ABSTRACT

A projectile having photoluminescent properties is exposed to light within a gun when propelled from the gun to excite the photoluminescent surface and provide a visual display by the propelled projectile. The projectile is illuminated by a flash lamp, such as a xenon flash lamp, having a high level ultraviolet light component and relatively low or non-existent red, orange and infrared components.

6 Claims, 3 Drawing Sheets

SYSTEM FOR LUMINESCING AND PROPELLING A PROJECTILE

This application is a continuation-in-part of U.S. patent application Ser. No. 08/644,959, filed May 13, 1996, now abandoned, which is a continuation of U.S. patent application Ser. No. 08/218,075, filed Mar. 25, 1994, now abandoned.

TECHNICAL FIELD

This invention relates to a method and apparatus for luminescing and propelling a projectile. The preferred embodiment disclosed herein has particular application to toy guns wherein a projectile simulating a tracer round is fired by the user. However, the invention does have application to other arrangements wherein it is desired to fire projectiles which emit a light, an example being a signal gun.

BACKGROUND ART

Many toys exist which simulate in some manner the operation of fire arms. It is well known, for example, to propel darts, balls and other projectiles from gun-like devices. The propulsion systems utilized in such devices vary widely and can include springs, pressurized gas systems and so forth. Quite a number of prior art designs for simulated weapons incorporate electrical or pyrotechnic means for providing lighting or sound effects. These audio and visual displays are sometimes employed in conjunction with toy weapons which propel a projectile of some type. In other cases, the lighting and sound effects are incorporated in simulated weapons which do not in fact propel a projectile of any type.

The systems shown in the following United States patents are believed to be representative of the state of the prior art: U.S. Pat. No. 5,415,151, issued May 16, 1995, U.S. Pat. No. 4,586,715, issued May 6, 1986, U.S. Pat. No. 5,229,531, issued Jul. 20, 1993, U.S. Pat. No. 689,547, issued Dec. 24, 1901, U.S. Pat. No. 4,351,503, issued Sep. 28, 1982, U.S. Pat. No. 3,902,722, issued Sep. 2, 1975, U.S. Pat. No. 4,843,751, issued Jul. 4, 1989, U.S. Pat. No. 4,242,831, issued Jan. 6, 1981, U.S. Pat. No. 2,905,863, issued Sep. 22, 1959, U.S. Pat. No. 3,968,784, issued Jul. 13, 1976, U.S. Pat. No. 5,261,384, issued Nov. 16, 1993, U.S. Pat. No. 4,236,348, issued Dec. 2, 1980, U.S. Pat. No. 3,859,977, issued Jan. 14, 1975, U.S. Pat. No. 5,261,852, issued Nov. 16, 1993, U.S. Pat. No. 2,977,580, issued Mar. 28, 1991, U.S. Pat. No. 3,240,924, issued Mar. 15, 1966, U.S. Pat. No. 3,220,732, issued Nov. 30, 1965, U.S. Pat. No. 2,568,279, issued Sep. 18, 1951, U.S. Pat. No. 2,734,310, issued Feb. 14, 1956, and U.S. Pat. No. 5,311,413, issued May 10, 1994.

The preferred form of apparatus disclosed herein relates to a toy gun which utilizes one or more photoluminescent projectiles to simulate tracer rounds. Typically, tracer ammunition utilized in actual weaponry contains a small pyrotechnic charge positioned in a hollow portion of a projectile. When the propelling charge is burned, the tracer charge is ignited and burns brightly as the projectile proceeds toward the intended target. Due to the photochemical persistence of the human eye, this traveling light source is perceived as an arc of light. When tracer ammunition is used at night, the trajectory of the projectile is easily monitored by this display.

With the present invention simulation of tracer bullets or other projectiles is simulated without the use of a burning projectile component. The structural elements and method steps utilized to accomplish the intended result are relatively simple, inexpensive and address the concerns of safety. The invention utilizes photoluminescent projectiles which are rapidly charged by superlumination to provide a toy that is not only inherently safe but highly interesting. The photoluminescent glow of the projectiles remains visible for a considerable length of time, making it a relatively easy matter to locate the projectiles in the dark after they have been projected.

U.S. Pat. No. 5,415,151 referenced above is worthy of particular comment, the patent disclosing a toy launcher which utilizes incandescent lamps to light a photoluminescent projectile at launch. Such an approach does not result in effective illumination of the projectile. Furthermore, considerable time is involved "charging" the photoluminescent projectile. The illuminated and propelled projectile has a relatively low level phosphorescence.

U.S. Pat. No. 5,311,413 discloses a device for energizing glow bait used for fishing using a flash lamp. The bait is exposed to the light from the flash lamp while the container of the device is closed. A lid is then opened and the bait manually removed by the fisherperson who then uses it in a conventional manner as bait.

DISCLOSURE OF INVENTION

The apparatus of the present invention is for luminescing and propelling a projectile at least partially comprised of photoluminescent material.

The apparatus includes means defining a space for receiving and temporarily accommodating therein a projectile at least partially comprised of photoluminescent material. Projectile propulsion means is provided for propelling a projectile at least partially comprised of photoluminescent material from the space and away from the apparatus.

Light emitting means of a specified character is incorporated in the apparatus for illuminating a projectile at least partially comprised of photoluminescent material in the space to excite the photo-luminescent material.

Actuator means is operatively associated with the projectile propulsion means for actuating the projectile propulsion means to propel a projectile at least partially comprised of photoluminescent material away from the apparatus after the photoluminescent material of the projectile has been excited by the light emitting means in the space whereby the projectile will emit light after being propelled from the apparatus.

The light emitting means includes at least one flash lamp for illuminating the projectile. The flash lamp contains a gas, such as xenon, for producing an intense short burst of light having a high level ultraviolet light component and relatively low or non-existent red, orange and infrared components when electrically actuated. The apparatus additionally comprises an electrical energy source for lighting the at least one flash lamp.

Other features, advantages, and objects of the present invention will become apparent with reference to the following description and accompanying drawings.

BEST MODE FOR CARRYING OUT THE INVENTION

Figure 1:
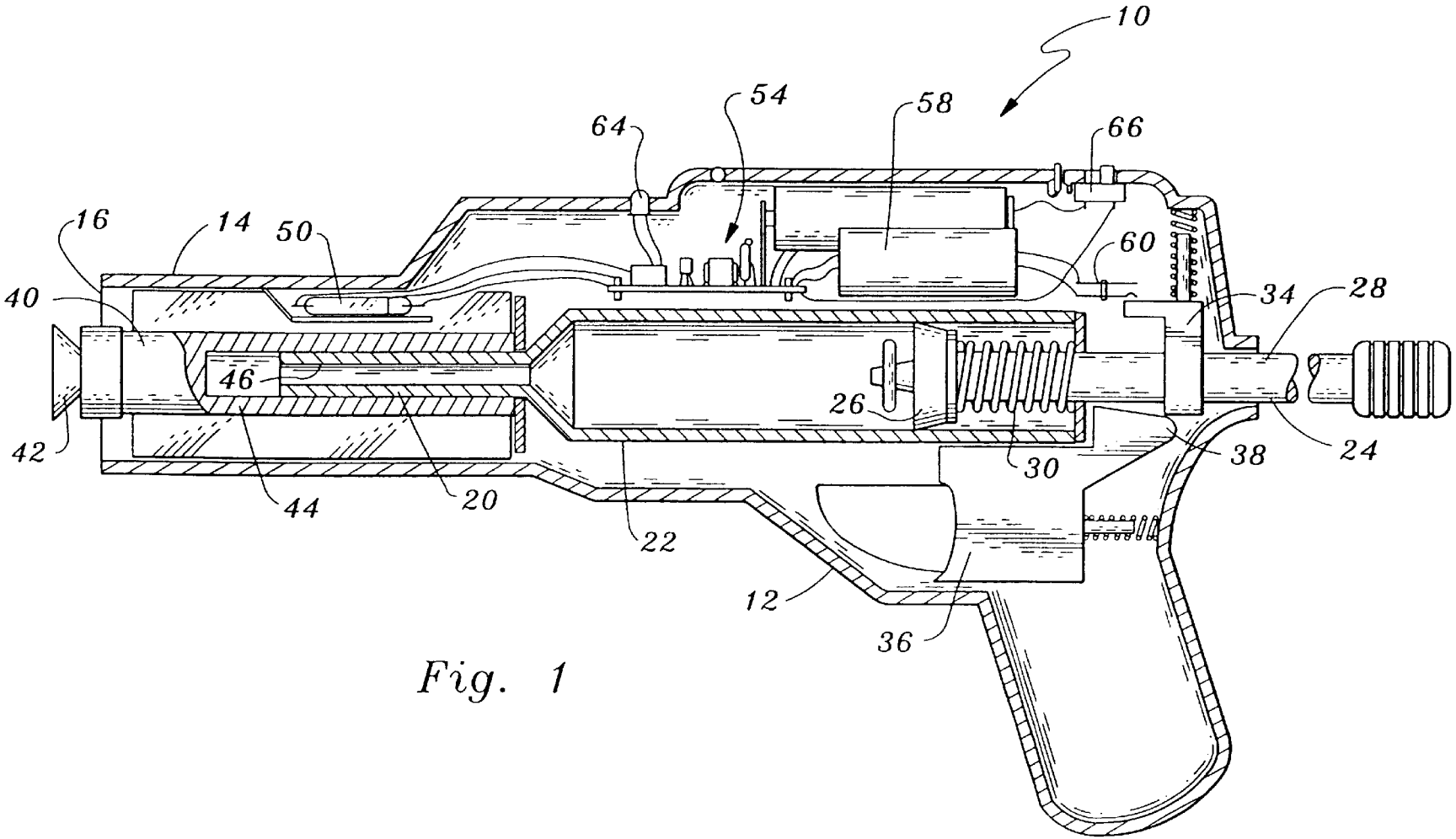
FIG. 1 is a sectional view of apparatus constructed in accordance with the teachings of the present invention with the structural elements thereof illustrated in the relative positions assumed thereby preparatory to luminescing and propelling a projectile in the form of a dart.

Referring now to the drawings, a toy gun 10 is illustrated, the toy gun including a housing 12 with a barrel 14 has an open end 16 and a barrel interior of circular cross-section leading from open end 16.

A nozzle element 20 comprising a portion of the toy gun's projectile propulsion system extends into the interior space of barrel 14. Nozzle 20 leads from a pneumatic cylinder 22.

A piston 24 having a piston head 26 and a piston shaft 28 is slidably disposed in pneumatic cylinder 22. A coil compression spring 30 biases the piston to the left as viewed in FIGS. 1 and 2 when the coil spring is compressed as shown in FIG. 1.

The piston 24 can be cocked in the position shown in FIG. 1 by pulling on the shaft 28 to bring a notch 32 (FIG. 2) to a spring biased retention member 34 which engages the piston shaft at the notch and will retain the piston in position with the coil spring 30 under compression.

Figure 2:
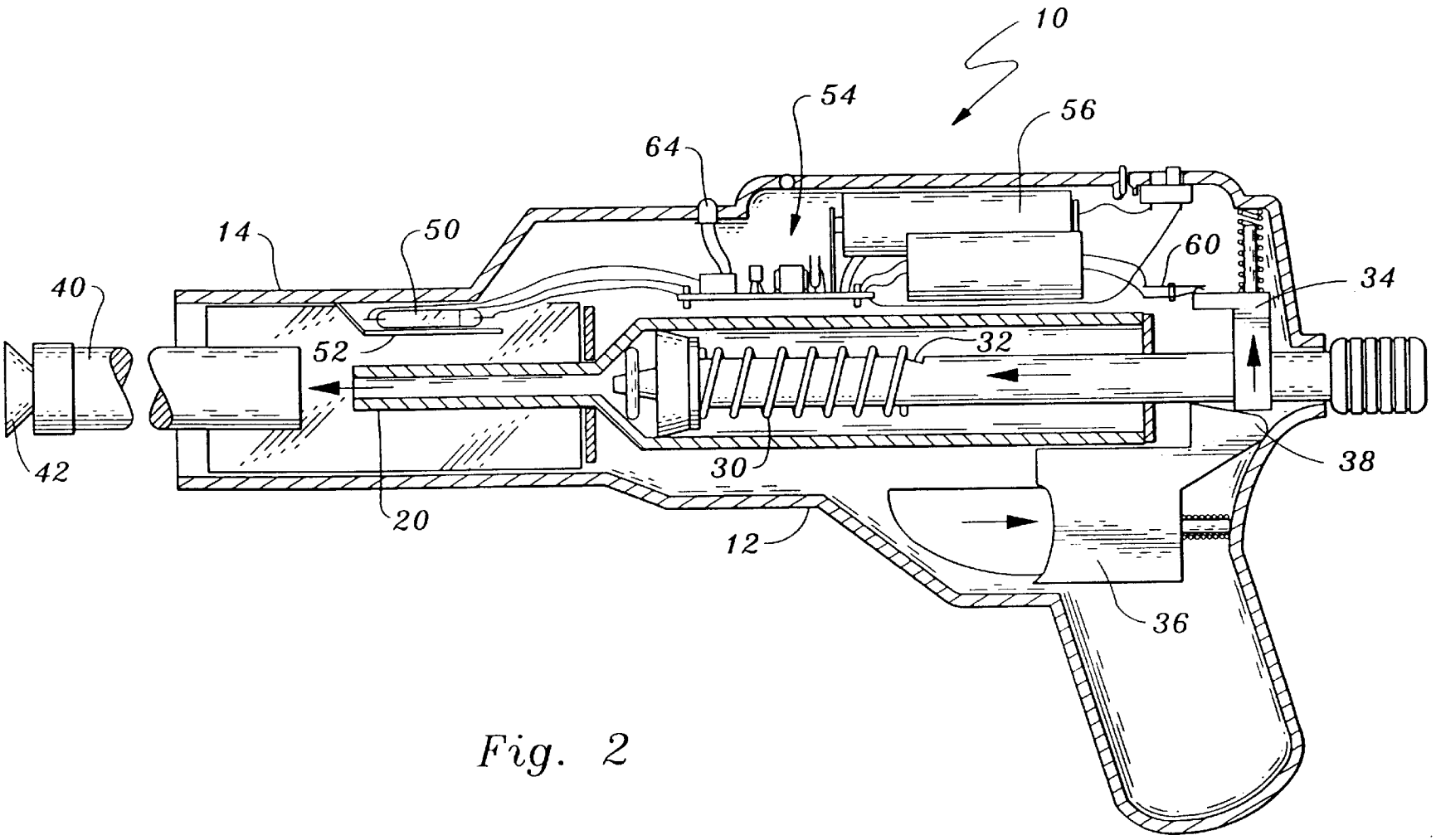
FIG. 2 is a view similar to FIG. 1 but illustrating the relative positions assumed by structural components when firing the projectile.
Figure 3:
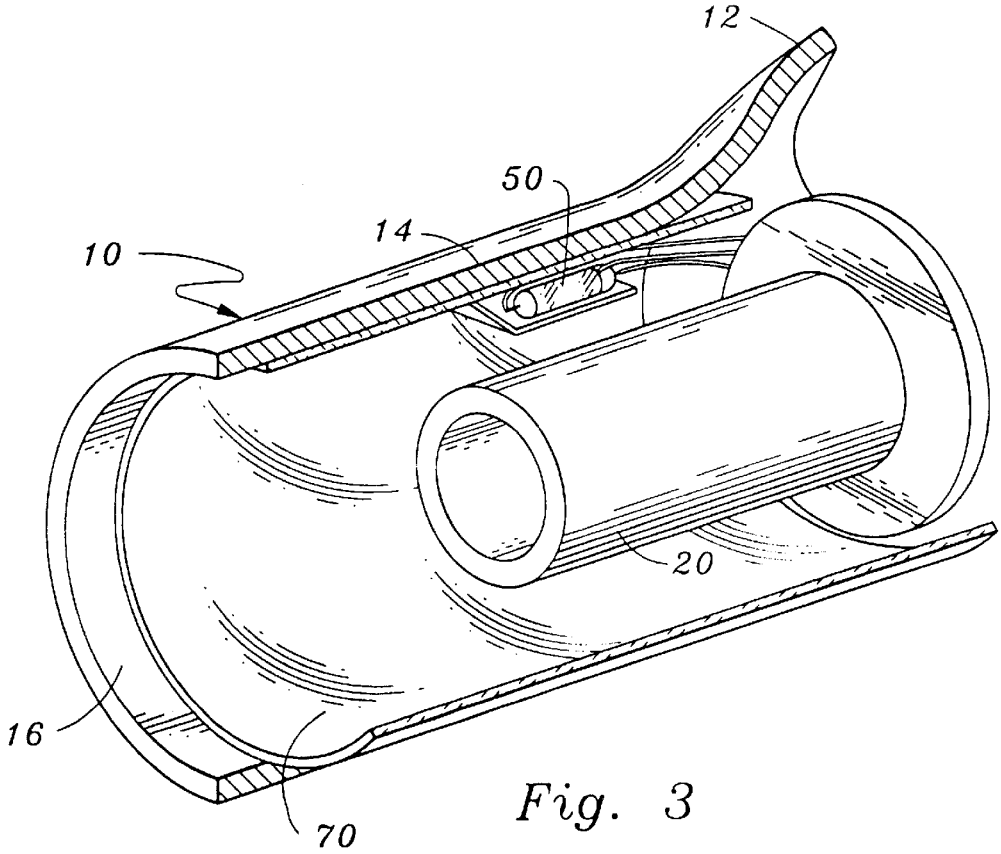
FIG. 3 is an enlarged, cut-away detail, perspective section illustrating the barrel of the gun and related structure.

A trigger 36 has a cam element 38 which will engage the bottom of retention member 34 to urge it in an upward direction as illustrated by the arrow in FIG. 2. This will cause the piston to be released and urged to the left as indicated by the arrow in FIG. 2.

Such movement will compress air within the pneumatic cylinder in front of the piston head and cause the compressed air to exit the end of nozzle 20.

Compressed air movement through the nozzle end will propel a projectile of a specified character. More particularly, the projectile for use with the toy gun is a dart 40 having a suction cup 42 at an end thereof. Dart 40 has a main body portion 44 defining a recess 46 which receives the nozzle 20 preparatory to firing of the toy gun. Preferably, the main body portion of the dart is constructed of a soft material such as plastic foam.

The toy gun structure described above is known in the prior art. The projectile conventionally fired by the toy gun just described does not emit light when fired and consequently does not approximate the action of a tracer bullet or projectile. In fact, a projectile such as dart 40 will be very difficult if not impossible to see when fired in the dark.

In accordance with the teachings of the present invention, all or part of projectile 40 comprises a photoluminescent material of any well known type. Nearly all modern, high efficiency, man-made photoluminescent materials consist of zinc sulphide with trace dopants, and such photoluminescent materials are suitable for use with the present invention. The materials are non-toxic and relatively inexpensive. Additionally, because of the relatively stable nature of the photoluminescent material, it is easily incorporated in molded plastic parts or in paints which can be applied by brushing or spraying. When excited by exposure to light, these materials will emit light even after the excitation light source is removed.

In order to practice the present invention with the arrangement illustrated in the drawings, it is required that the projectile 40 be at least partially comprised of photoluminescent material. The material can be either wholly or partially coated on the dart or actually incorporated in the material utilized in the construction of the dart.

Figure 4:
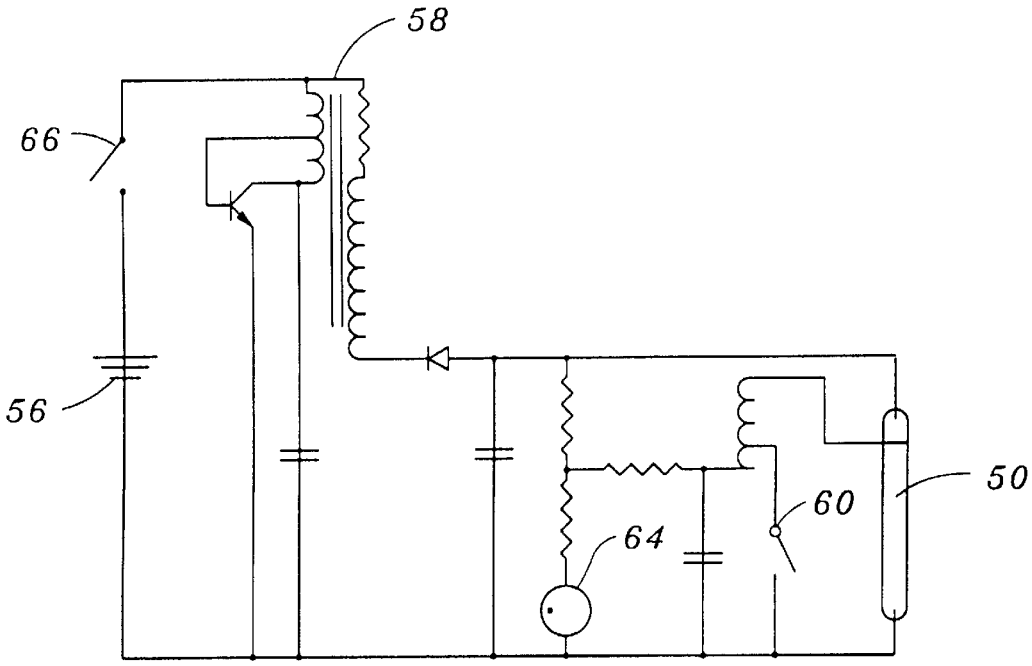
FIG. 4 is a schematic circuit for powering and triggering a flash lamp utilized in the invention.

With the structure now to be described the photoluminescent material is exposed to light from a light source while the projectile is within the space defined by the barrel 14 of the toy gun. In the arrangement illustrated, light emitting means in the form of a xenon flash lamp 50 is located within the confines of the barrel. More particularly, the lamp 50 is supported on a transparent support 52 constructed of plastic or the like adjacent to a dart 40 disposed on nozzle 20 as shown in FIG. 1. Flash lamp 50 is connected to a suitable circuit of the type utilized to power and trigger xenon flash lamps such as those commonly employed for flash photography. FIG. 4 illustrates a typical circuit of this type. The actual circuit components are generally designated by reference numeral 54 in FIG. 1 and 2. The source of power is a battery 56, for example, a AA alkaline battery.

A xenon flash lamp provides a compact, high intensity source of light which is well suited to the operation of the present invention. When discharged, a xenon lamp emits an extremely bright short burst of light. Typically, flash duration may be in the order of 1 to 2 milliseconds. Because the light energy is concentrated in an intense short burst, the lamp may be triggered simultaneously with the initiation of propulsion of the photoluminescent projectile 40. The initial relatively slow movement of the projectile as it accelerates provides ample time for the flash lamp to charge the projectile before the projectile moves out of range of the lamp. Xenon flash lamps typically require a device for energy storage, normally a capacitor such as that denoted by reference numeral 58 and a high voltage charging circuit of the type shown in FIG. 4.

A trigger actuator switch 60 closes the circuit operatively associated with xenon flash lamp 50 and activates the lamp when the capacitor 58 is adequately charged. Charging can take place within a matter of seconds. Switch 60 is normally open. Depression of trigger 36 and movement thereof to the right as viewed in FIGS. 1 and 2 will cause retention member 34 to close switch 60 as shown in FIG. 2 and thus actuate the lamp at substantially the same time that piston 24 is released by the retention member and allowed to move to the left as viewed in FIG. 2 to propel the dart 40 forward.

The projectile will emit light as it exits the toy gun and proceeds to its destination.

The essence of the present invention resides in the fact that a flash lamp of a specified character is employed to illuminate the photoluminescent projectile. In particular, the flash lamp produces an intense short burst of light having a high level ultraviolet radiation component and relatively low or non-existent red, orange and infrared components.

Known prior art in this field fails to recognize the vastly improved results arising from use of a flash lamp having these desired light characteristics.

Use of a flash lamp of specific character as taught herein produces an exciting and dramatic visual effect previously unknown in the toy field. This dramatic visual effect is pronounced even in artificially illuminated rooms when utilizing the most efficient wavelengths of photo-excitation of photoluminescent materials; those which are in the ultraviolet region. Incandescent lamps, as employed in the prior projectile illuminating art, are very inefficient producers of ultraviolet light. Even production of visible light is often less than 2% efficient in incandescent lamps.

Not only is a flash lamp of the type exemplified by a xenon flash lamp far more efficient in the conversion of electrical energy to light, but also particularly in the production of desirable ultraviolet light where it is approximately 1,000 times more efficient than incandescent lamps.

Employment of a flash lamp such as a xenon flash lamp having a high level ultraviolet component and relatively low or non-existent red, orange and infrared components provides for unexpected, phenomenally improved results when illuminating and projecting a projectile from a toy gun barrel.

An even more insidious and unobvious problem associated with employing incandescent lamps as excitation sources for a photoluminescent projectile exists. Incandescent lamps are not only very poor producers of ultraviolet light but they are relatively efficient in the production of infrared energy. Additionally, despite their inefficiency, a fair amount of red and orange light is produced by these types of lamps as well.

Photostimulation is the process whereby an excited phosphor can be forced to release its stored energy at a rate which exceeds its normal decay rate. This process can occur when the photoluminescent material is illuminated by a light of longer wavelength than that of the excitation band of the photoluminescent material. Illumination of phosphors such as hex-ZnS:Cu by infrared radiation, such as that provided by incandescent lamps, forces the phosphor to dump or discharge its energy prematurely and instantaneously during the illumination so that very little, if any, afterglow will be observed. Illumination of the phosphor by orange or red light produces an effect known as photoquenching. When an excited phosphor is photoquenched its stored energy is not released as desirable photons but is dissipated non-radiatively as heat.

Because illumination with an incandescent lamp can cause not only excitation (albeit ineffectively) of a phosphor but also causes simultaneous stimulation and quenching during illumination, one can see that the use of incandescent lamps for exciting luminous materials is highly impractical. One could employ a thousand incandescent lamps in a mile long tube and still not attain the results of the present invention wherein a single flash lamp may be employed, for example.

On the other hand, employment of a flash lamp containing a gas such as xenon for producing an intense short burst of light having a substantially higher ultraviolet light component than infrared light component when actuated is highly conducive to efficient excitation of many luminous materials. Not only is the flash lamp extremely efficient in the conversion of electrical energy to light, but, as stated above, also in the production of desirable ultraviolet light where it is approximately 1,000 times more efficient than incandescent lamps. Additionally, relative output of red, orange and infrared light is low, so that the undesirable process of stimulation and quenching are greatly diminished.

If desired, a ready light of the type normally found on flash photography devices may be employed to indicate when capacitor 58 is adequately charged. The ready light is designated by reference numeral 64. A conventional slide-type on/off switch 66 can be used to disable or enable the flash system.

It is desirable to completely surround the projectile 40 with light, particularly when the entire body of the dart is photoluminescent. For this purpose, a mirror-like sheet of metal or other highly reflective material 70 is disposed about the complete internal periphery of the barrel. This ensures relative uniform application of light from xenon flash lamp 50.

We claim:

1. Projectile propelling and illuminating apparatus for luminescing and propelling a projectile at least partially comprised of photoluminescent material having an excitation band of determinable wavelength, said apparatus comprising, in combination:

means including a gun barrel defining an interior at least partially comprising a gun barrel interior for receiving and temporarily accommodating therein at a selected location a projectile at least partially comprised of photoluminescent material, said gun barrel additionally defining an open end spaced from said selected location and defining a path of movement for a projectile extending between said selected location and said open end;

projectile propulsion means for propelling a projectile at least partially comprised of photoluminescent material from said selected location, along said path of movement, out of said open end, and away from said apparatus;

non-incandescent light emitting means for illuminating a projectile at least partially comprised of photoluminescent material with an intense short burst of light having a high level ultraviolet light component within the wavelength of the excitation band of the photoluminescent material of the projectile and relatively low or non-existent red, orange and infrared components of longer wavelength than that of the excitation band of the photoluminescent material of the projectile at said selected location to excite the photoluminescent material with said light having a high level ultraviolet light component and relatively low or non-existent red, orange and infrared light components, said light emitting means including at least one flash lamp for illuminating a projectile at said selected location, said flash lamp containing a gas for producing an intense short burst of light having a high level ultraviolet light component and relatively low or non-existent red, orange, and infrared light components when electrically actuated;

an electrical energy source; and actuator means including a trigger operatively associated with said projectile propulsion means and said light emitting means for substantially simultaneously completing an electrical connection between said at least one flash lamp and said electrical energy source and actuating said projectile propulsion means to propel a projectile at least partially comprised of photoluminescent material from said selected location at substantially the same time the photoluminescent material of the projectile is excited by the ultraviolet light component from the flash lamp of said light emitting means whereby said projectile will emit visually observable light when propelled from said apparatus from the open end of the gun barrel and whereby there will not be significant quenching of said visually observable light caused by the flash lamp.

2. The apparatus according to claim 1 wherein said flash lamp is a xenon lamp.

3. The apparatus according to claim 1 additionally comprising a reflective surface located in said barrel interior for reflecting light from said at least one flash lamp onto the projectile.

4. The apparatus according to claim 1 wherein said trigger is a manually movable trigger.

5. The apparatus according to claim 1 additionally comprising signal means for indicating when said electrical energy source is capable of operating said light emitting means.

6. A portable battery operated gun and illuminated projectile apparatus comprising in combination:

a projectile, said projectile comprising a photoluminescent material having an excitation band of determinable wavelength;

gun barrel means, said gun barrel means including a hollow interior for receiving and temporarily accommodating said projectile therein at a selected location and an open end spaced from said selected location, said gun barrel means further defining a path of movement for said projectile within said hollow interior that extends between said selected location and said open end;

non-incandescent light emitting xenon flash lamp means for producing a short burst of high intensity light within said gun barrel means, responsive to actuation, to expose said photoluminescent material of said projectile means when said projectile means is accommodated at said selected location, said short burst of high intensity light being no greater than about two milliseconds in duration, and said high intensity light comprising a spectral characteristic having a predominant ultraviolet component within the wavelength of the excitation band of the photoluminescent material to excite said photoluminescent material and minimal components if any of red, orange and infrared of longer wavelength than that of the excitation band of the photoluminescent material of the projectile as would also quench said excitation of said photoluminescent material;

light reflector means, said light reflector means located in said interior of said gun barrel and at least surrounding said selected location for reflecting said high intensity light produced by said xenon flash lamp means onto said photoluminescent material of said projectile;

projectile propulsion means for propelling said projectile from said selected location in said gun barrel means, along said path of movement, out of said open end, and away from said gun barrel means;

actuator means operatively associated with said projectile propulsion means and with said non-incandescent light emitting xenon flash lamp means for substantially simultaneously actuating said projectile propulsion means and actuating said non-incandescent light emitting xenon flash lamp means, whereby said photoluminescent material of said projectile is excited by said ultraviolet component of said burst of light produced by said xenon flash lamp means and, responsive thereto, generates a visible light, said generated visible light being of sufficient intensity to be visually observable when said projectile is propelled from said open end of said gun barrel means and throughout said projectile's flight therefrom;

said actuator means comprising at least:

a trigger;

an electrical energy source;

said electrical energy source including a battery for supplying DC; and capacitive discharge means, coupled to said battery, for providing electrical power to said xenon flash lamp means, responsive to actuation of said trigger.

* * * * *